US008992204B2

(12) United States Patent
Druschel

(10) Patent No.: US 8,992,204 B2
(45) Date of Patent: Mar. 31, 2015

(54) PATCH COATING DIE

(75) Inventor: Robert L. Druschel, Eau Claire, WI (US)

(73) Assignee: Nordson Corporation, Westlake, OH (US)

( * ) Notice: Subject to any disclaimer, the term of this patent is extended or adjusted under 35 U.S.C. 154(b) by 897 days.

(21) Appl. No.: 12/899,109

(22) Filed: Oct. 6, 2010

(65) Prior Publication Data

US 2012/0088006 A1 Apr. 12, 2012

(51) Int. Cl.
*B05C 5/00* (2006.01)
*B05C 5/02* (2006.01)

(52) U.S. Cl.
CPC ..... *B05C 5/0258* (2013.01)
USPC ..... 425/224

(58) Field of Classification Search
USPC ..... 425/224
See application file for complete search history.

(56) References Cited

U.S. PATENT DOCUMENTS

| | | | | |
|---|---|---|---|---|
| 4,565,217 | A | 1/1986 | McIntyre | |
| 4,725,468 | A | 2/1988 | McIntyre | |
| 4,751,029 | A * | 6/1988 | Swanson | 264/40.4 |
| 4,756,271 | A | 7/1988 | Maier | |
| 5,066,435 | A | 11/1991 | Lorenz et al. | |
| 5,136,972 | A * | 8/1992 | Naka et al. | 118/410 |
| 5,147,195 | A | 9/1992 | Cloeren | |
| 5,284,430 | A | 2/1994 | Tomic et al. | |
| 5,843,230 | A | 12/1998 | Potjer et al. | |
| 5,851,566 | A | 12/1998 | Potjer et al. | |
| 6,455,105 | B1 | 9/2002 | Sakai et al. | |
| 6,641,671 | B2 | 11/2003 | Shinozaki et al. | |
| 6,776,807 | B2 | 8/2004 | Shida et al. | |
| 7,052,551 | B2 | 5/2006 | Shida et al. | |
| 7,449,216 | B2 | 11/2008 | Lobo et al. | |
| 2002/0029465 | A1 * | 3/2002 | Shida et al. | 29/623.5 |
| 2008/0277423 | A1 * | 11/2008 | Garton | 222/185.1 |

FOREIGN PATENT DOCUMENTS

| | | | |
|---|---|---|---|
| DE | 19731248 | A1 * | 1/1999 |
| JP | 07-323360 | | 12/1995 |
| JP | 08-257467 | | 10/1996 |
| JP | 11-197578 | | 7/1999 |
| JP | 2007-066744 | | 3/2007 |
| JP | 2010-188289 | | 9/2010 |

* cited by examiner

*Primary Examiner* — Ryan Ochylski
(74) *Attorney, Agent, or Firm* — Fredrikson & Byron, P.A.

(57) ABSTRACT

A coating die having a shut-off bar positioned to stop the flow of coating material within the flow channel of the die when the shut-off bar is in the closed position. In the closed position, the shut-off bar extends across the material flow channel, blocking flow of coating material therethrough. The shut-off bar moves essentially orthogonal to the direction of material flow. In some embodiments, the flow channel includes a shoulder against which the shut-off bar physically seals, the seal being essentially transverse or orthogonal to the direction of the material flow channel. Coating dies having a shut-off bar are particularly suited for patch coating applications.

12 Claims, 3 Drawing Sheets

PATCH COATING DIE

FIELD

The present invention relates to coating dies or applicator dies for applying a liquid coating material to a moving sheet or web.

BACKGROUND

A coating die is used to apply a thin layer of liquid material (e.g., thermoplastic or solvent based) to a support substrate such as a sheet or film. The most common coating process is to provide a continuous layer of coated material on the substrate by having a continuous stream of material applied to the moving substrate. However, occasionally it is desired to coat a strip or patch of material, the patch having a specific length, with uncoated areas therebetween. Such 'patch coating' is often desired for applications such as adhesive labels, batteries (e.g., lithium ion batteries), and for biological studies. For these instances, the application of the coating material is temporarily stopped or interrupted while the substrate continues to move, providing an area of un-coated substrate around the perimeter of the coating.

One attempt to provide an apparatus that can temporarily stop the flow of coating material is described in U.S. Pat. No. 4,756,271 to Maier. This patent describes a coating die that includes a rotatable cam inside, which can be rotated among different fluid chambers to select different materials or to interrupt the coating during web movement.

Another attempt to provide an apparatus that can temporarily stop the flow of coating material is described in U.S. Pat. No. 4,725,468 to McIntyre. This patent describes a method of co-extruding a discontinuous or sectioned coating over a continuous coating. A 3-way poppet valve (such as described in U.S. Pat. No. 4,565,217) can be intermittently shuttered by an electronic control circuit to control the flow of the discontinuous material.

These designs, however, can be problematic for high speed coating, because the on and off flow stopping is not fast enough or sufficiently accurate for short un-coated distances between patches. There is always room for improvement.

BRIEF SUMMARY

The present disclosure relates to a coating apparatus and more particularly to a coating die for intermittently applying liquid material onto a substrate. The coating die includes a shut-off bar located in the material flow channel within the die, the shut-off bar being activated (i.e., raised and lowered) using magnetic actuators which have fast acceleration and are highly accurate. Closing the shut-off bar stops the flow of coating material through and out of the die, thus interrupting the flow of coating material onto the substrate being coated.

In one particular embodiment, this invention is directed to a coating die having a die body with a flow channel therethrough, the flow channel in fluid communication with a die inlet and a die outlet. A shut-off bar in the die is moveable from an open position out of the flow channel to a closed position into the flow channel, the shut-off bar having an upstream surface, a downstream surface, and an end therebetween. When the shut-off bar is in the closed position, the downstream surface physically contacts the flow channel, and the shut-off bar end makes no contact with the walls that define the flow channel. In some embodiments, a flow channel wall may define a shoulder, so that when in the closed position, the downstream surface of the shut-off bar physically contacts the shoulder of the flow channel. The shut-off bar may move linearly from the open position out of the flow channel to the closed position in the flow channel. The shut-off bar may move orthogonally in relation to the flow channel, which may be vertically. The end of the shut-off bar may be slanted down from the upstream surface to the downstream surface.

In another particular embodiment, this invention is directed to a coating die having a die body with a flow channel therethrough, the flow channel in fluid communication with a die inlet and a die outlet, and with the flow channel defined by a first wall and an opposite second wall, the second wall defining a shoulder. The coating die includes a shut-off bar moveable from an open position out of the flow channel to a closed position into the flow channel, the shut-off bar having upstream surface and a downstream surface. When the shut-off bar is in the closed position, it extends across the flow channel and the downstream surface physically contacts the shoulder stopping flow through the flow channel.

In yet another particular embodiment, this invention is directed to a coating die having a die body with a flow channel therethrough, the flow channel in fluid communication with a die inlet and a die outlet. The die includes a shut-off bar moveable from a first position to a second position, so that when in the first position, the flow channel is open for flow of coating material therethrough and when in the second position, the flow channel is closed to flow of coating material therethrough. The seal formed by the shut-off bar is at a right angle to the flow channel. In some embodiments, the shut-off bar may move at a right angle to the flow channel, for example, linearly from the first position to the second position in the flow channel. The shut-off bar may move orthogonally in relation to the flow channel, which may be vertically.

These and various other features and advantages will be apparent from a reading of the following detailed description.

BRIEF DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

In the following description, reference is made to the accompanying set of drawings that form a part hereof and in which are shown by way of illustration at least one specific embodiment. It is to be understood that other embodiments are contemplated and may be made without departing from the scope or spirit of the present disclosure. The following detailed description, therefore, is not to be taken in a limiting sense. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

The present disclosure relates to coating dies that have a shut-off bar positioned to stop the flow of coating material within the flow channel of the die when the shut-off bar is in the closed position. In the closed position, the shut-off bar extends across the material flow channel, blocking flow of coating material therethrough. The shut-off bar moves essentially transverse or orthogonal to the direction of material flow and the seal formed by the shut-off bar to block the flow is essentially transverse or orthogonal to the direction of material flow. In some embodiments, the flow channel includes a shoulder against which the shut-off bar seals, the seal being essentially transverse or orthogonal to the direction of the material flow channel. Coating dies having a shut-off bar are particularly suited for patch coating applications.

While the present disclosure is not so limited, an appreciation of various aspects of the disclosure will be gained through a discussion of the examples provided below.

Figure 1A:
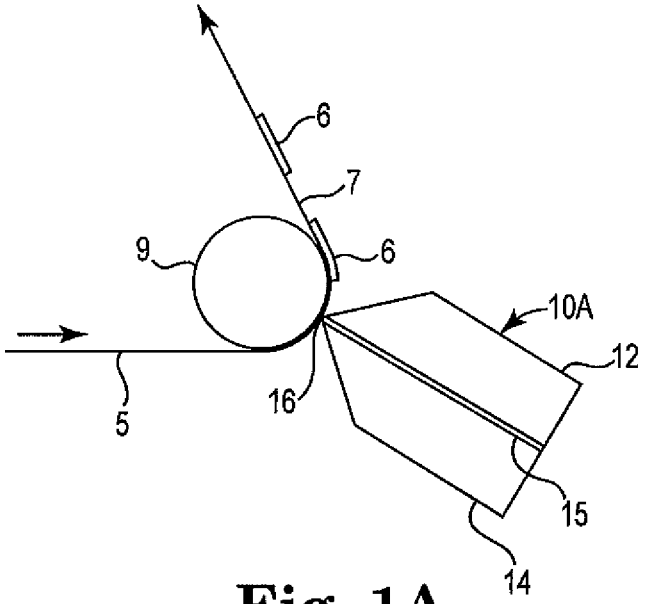
FIG. 1A is a schematic side view of a coating die apparatus for patch coating.
Figure 1B:
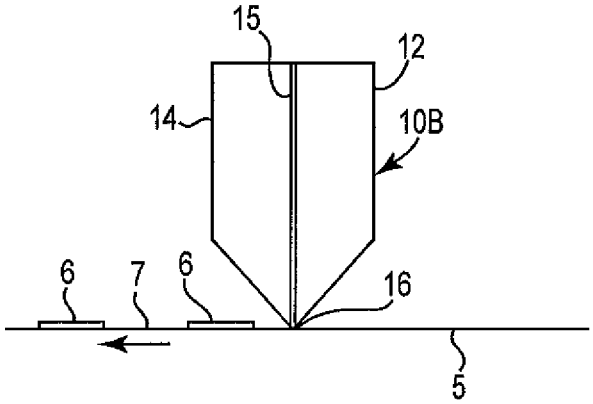
FIG. 1B is a schematic side view of another coating die apparatus for patch coating.

FIGS. 1A and 1B illustrate two generic processes for manufacturing continuous webs of patch coated material. Both processes include a coating die in accordance with the present disclosure that applies a coating material (for example, a thermoplastic material, solvent based, or a high-solids liquid material) to a moving substrate or web. As used in this discussion and throughout, "length" refers to the dimension in the direction of travel of the substrate (i.e., the machine direction) past the coating outlet and "width" refers to the dimension taken transverse to the machine direction.

In FIG. 1A, a continuous sheet or web of substrate 5 is provided onto which regions of coating 6 are applied. Between regions of coating 6 are substrate regions void of coating 7. Coated regions 6 and void regions 7 are formed by coating die 10A applying the coating material in an intermittent manner; that is, coating die 10A starts, stops, and restarts the application of the coating material onto substrate 5 as substrate 5 passes by coating die 10A. Coating die 10A has a first or upper die body 12, a second or lower die body 14 and a flow channel 15 therebetween. Coating material passes through flow channel 15 from a coating material source (not illustrated), such as an extruder, to outlet 16 where the coating material is applied to substrate 5. In this configuration for FIG. 1A, coating die 10A deposits coated material on substrate 5 opposite a backup roll 9. The apparatus of FIG. 1A, which utilizes backup roll 9 opposite coating die 10A, is often referred to as "supported web" or "on-roll" coating.

Similar to the process illustrated in FIG. 1A, in FIG. 1B a continuous sheet or web of substrate 5 is provided onto which regions of coating 6 are applied. Between regions of coating 6 are substrate regions void of coating 7. Coated regions 6 and void regions 7 are formed by coating die 10B applying the coating material in an intermittent manner; that is, coating die 10B starts, stops and restarts the application of the coating material onto substrate 5 as substrate 5 passes by coating die 10B. Coating die 10B has a first or upper die body 12, a second or lower die body 14 and a flow channel 15 therebetween. Coating material passes through flow channel 15 from a coating material source (not illustrated), such as an extruder, to outlet 16 where the coating material is applied to substrate 5. The apparatus of FIG. 1B is often referred to as "tension web" coating or "off-roll" coating.

In both processes illustrated in FIGS. 1A and 1B, coated regions 6 are eventually dried or cured, resulting in an elongate product having patches of coated regions 6 extending in the machine direction or direction of substrate 5 with regions void of coating 7 between adjacent coated regions 6.

Coating processes such as illustrated in FIGS. 1A and 1B can operate at a wide range of production speeds. For example, it is not uncommon for commercial embodiments of the above arrangement to operate at rates from a few feet per minute to 3500 feet per minute using webs having widths of less than one foot, one meter, or more. It is understood that substrates of almost any length and/or width can be used with these coating processes. Although in most embodiments the substrate being coated is a flexible substrate such as a polymeric film, rigid substrates may also be coated with the dies and processes described herein.

Many different coating compositions can be coated by the processes and the coating dies of this disclosure. The coating material may be, for example, hot melt or thermoplastic materials (e.g., adhesives), solvent-based materials, low VOC-based materials, emulsion-based adhesives, and high-solids materials. Furthermore, a wide variety of different liquid coatings, such as pressure sensitive adhesives, conductive coatings, insulating or non-conductive coatings, and inks, can be applied using coating dies and techniques as described herein. Two applications that are particularly conducive to patch coating are formation of battery cells (e.g., lithium ion batteries) and solar panel or photovoltaic parts.

Figure 2:
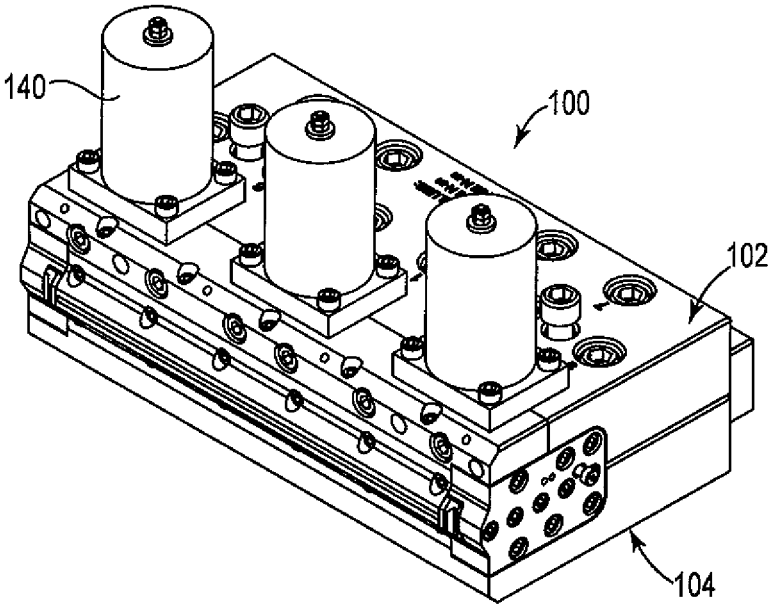
FIG. 2 is a perspective view of a coating die of the present disclosure.
Figure 3:
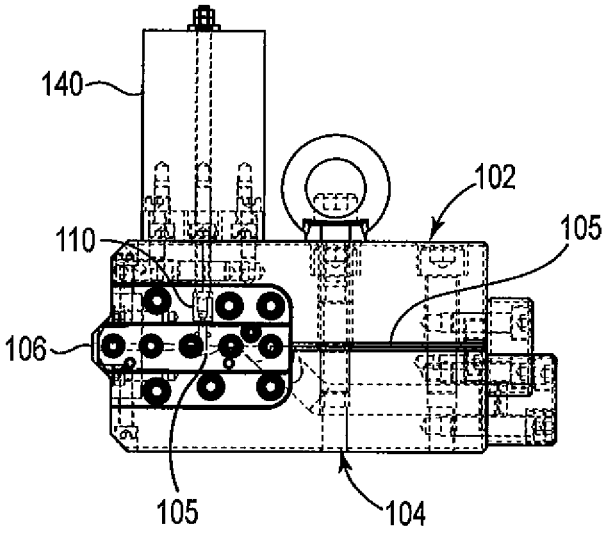
FIG. 3 is a side view of the coating die of the present disclosure.

Returning to FIGS. 1A and 1B, alternating coated regions 6 and regions void of coating 7 are produced by a coating die according to this disclosure that has an internal shut-off bar that is actuated to interrupt the flow of coating material through the die. Referring now to FIGS. 2 and 3, a coating die 100 has a general overall configuration that is well known, having a first or upper die body 102 and a mating second or lower die body 104. Die bodies 102, 104 define therebetween a flow channel 105 for passage of coating material through die 100. Coating material enters die at an inlet (not illustrated) and exits via outlet 106; in the Figures, the inlet is located at the right side of the illustration and outlet 106 is on the left side, so that coating material flows through channel 105 from right to left.

Flow channel 105 is generically referred to herein and is not described in detail. Those skilled in the art of coating dies and coating processes understand that flow channel 105 includes a manifold downstream of the inlet, the manifold being for distributing the coating material across the width of the die. The manifold may be any suitable type, such as a horseshoe or Winter manifold, a coat hanger manifold, a fishtail manifold, or a t-manifold, and does not affect the inventive features of die 100. Downstream of the manifold may be a preland region prior to a land region that leads to outlet 106. Flow channel 105 may include other features, such as transition areas or run-out areas. The manifold, preland and land are arranged substantially parallel to and substantially as wide as the corresponding outlet 106 to provide a uniform delivery of liquid coating material widthwise across the web to be coated. Lands and/or outlet 106 are typically adjustable in height so that the thickness of coating applied can be adjusted as desired. The width of outlet 106 may be fixed or may be adjustable, for example, by deckling or a deckling system.

Coating die 100 includes an internal shut-off bar that is used to interrupt the flow of coating material in flow channel 105 through die 100. Referring to FIG. 4, a shut-off bar 110 for die 100 includes a blade 112 that extends the width of at least outlet 106 and in most embodiments the width of die 100. Blade 112 defines an upstream surface 114 and a downstream surface 11 of shut-off bar 110. Blade 112 is sufficiently rigid to withstand the pressure of coating material pushing against it without deforming; as an example, a blade 112 about 0.1 inch (about 2.5 mm) to 0.25 inch (about 6.3 mm) thick is able to withstand fluid pressures on the order of 28 psi, although both higher and lower pressures may be encountered on blade 112, depending on the pressure of the coating material entering die 100 and the time duration shut-off bar 110 is closed. In general, a thinner blade 112 is preferred over a thicker blade 112, as a thinner blade will require less actuator force to overcome the fluid pressure pushing back up against blade 112 and its end 115 as it is lowered.

Blade 112 has an end 115 between upstream surface 114 and downstream surface 116. In some embodiments, end 115 is an angled or slanted end, sloping down from upstream surface 114 to downstream surface 116. Benefits of a slanted end 115 are described below. A portion of shut-off bar 110 is moveable into and out from flow channel 105 to interrupt the flow of coating material therethrough.

Figure 4A:
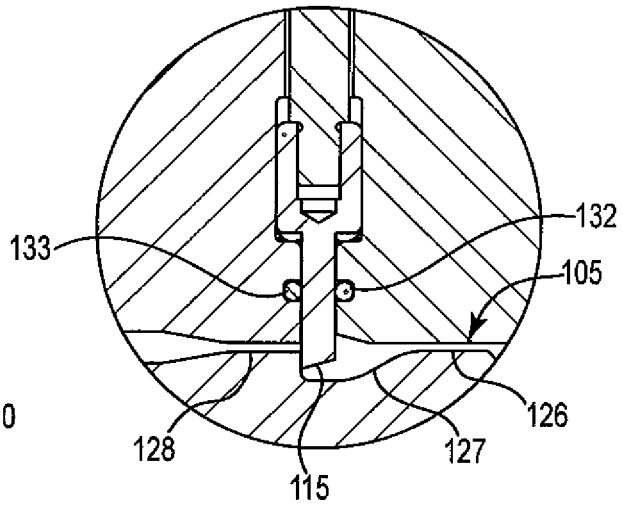
FIG. 4A is an enlarged side view of the coating die of FIG. 3 illustrating the shut-off bar of FIG. 4 in a closed position.
Figure 4:
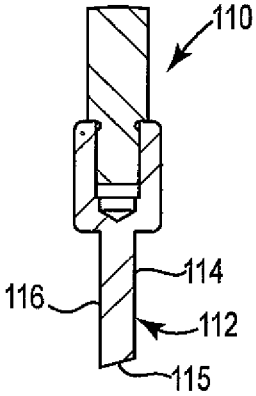
FIG. 4 is a side view of a shut-off bar.
Figure 4B:
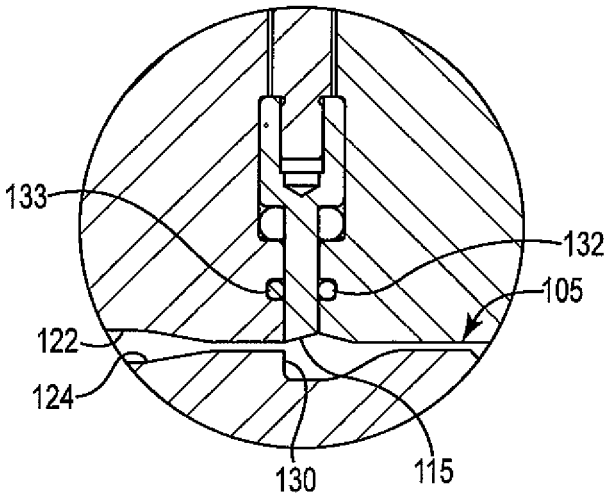
FIG. 4B is an enlarged side view of the shut-off bar in an open position.

FIGS. 4A and 4B illustrate shut-off bar 110 in a closed and an open position, respectively. To move from the open to closed position and back, shut-off bar 110 moves in a direction essentially transverse or orthogonal to flow channel 105 and to the material flowing within channel 105. For embodiments of die 100 where flow channel 105 is essentially horizontal, shut-off bar 110 moves essentially vertically, and in preferred embodiments moves exactly vertically and in a linear motion. In the closed position, FIG. 4A, shut-off bar 110 extends into flow channel 105 and creates a dam across flow channel 105 to inhibit (and preferably completely stop) the flow of coating material through flow channel 105. In the open position, FIG. 4B, shut-off bar 110 is retracted at least partially out and preferably completely out from flow channel 105 and thus allows coating material to flow through flow channel 105.

In the illustrated embodiment, channel 105 has a topography that is not constant along its length. One skilled in the art of coating die design is able to readily determine the specific topography of flow channel 105, both of upper wall 122 and lower wall 124, needed to obtain the desired coating characteristics for the coating process. In this embodiment, both upper wall 122 of channel 105 and lower wall 124 of channel 105 are not level, so that the height of flow channel 105, measured between upper wall 122 and lower wall 124, varies along the length of flow channel 105. In this embodiment, the elevation of lower wall 124 deviates more than that of upper wall 122 does.

Also in this illustrated embodiment, the topography of flow channel 105 includes an upstream necked region 126, an enlarged region 127 and a downstream necked region 128, with shut-off bar 110 positioned to extend into channel 105 proximate to the transition from enlarged region 127 to downstream necked region 128. The transition between enlarged region 127 and downstream necked region 128 is defined by a shoulder 130 (see FIG. 4B).

No matter what the specific topography of flow channel 105, shut-off bar 110 is located downstream from the manifold portion of flow channel 105. In some designs, shut-off bar 110 is within the portion of flow channel 105 that is considered the preland region, upstream of the land region. In other designs, shut-off bar 110 is within the portion of flow channel 105 that is a transition region upstream of the preland region.

Returning to FIG. 4A, when in the extended or closed position, shut-off bar 110 is in close proximity to and preferably abuts shoulder 130. As indicated above, the flow of coating material through flow channel 105, in this embodiment, is from right to left, so that downstream surface 116 of shut-off bar 110 physically contacts and provides a seal with shoulder 130. The physical contact between shut-off bar 110 and shoulder 130, transverse to the flow direction of material in flow channel 105, provides a more secure and leak-free seal than would a seal that extends in the flow direction of material in flow channel 105, such as a seal between end 115 of shut-off bar 110 and lower wall 124. Additionally, less wear or damage occurs to a side wall (e.g., downstream surface 116) when sliding to form a physical seal than compared to slamming against a surface, as would a seal between end 115 and lower wall 124. Shut-off bar 110 does not "bottom out" (i.e., end 115 does not contact lower wall 124). To inhibit coating material from wicking up along shut-off bar 110 and contaminating other parts of die 100, various seals 132, 133 may be present.

In addition to the transverse physical contact between shoulder 130 and shut-off bar 110, the fluid pressure of the coating material dammed by closed shut-off bar 110 pushes against upstream surface 114 of shut-off bar 110, further increasing the contact and seal between shoulder 130 and downstream surface 116 of shut-off bar 110. To allow flow of coating material through flow channel 105, shut-off bar 110 is retracted or opened, as illustrated in FIG. 4B.

One benefit of having an angled, slanted or sloped end 115 of shut-off bar 110 can be seen in FIG. 4B. In the open, retracted position (FIG. 4B), the slanted end 115 creates a smooth transition in upper wall 122 between the enlarged region 127 of flow channel 105 and necked region 128, which provides a smoother fluid flow past shut-off bar 110. Additionally, the pressure drop distribution through the area where shut-off bar 110 is located can be easily calculated and designed when the upper wall 122 has a smooth transition. Having the slanted or sloped end 115 also decreases the force needed to overcome the fluid pressure pushing back up against blade 112 as it is lowered. Another benefit of having a slanted or sloped end 115 is that the sloped end 115 can be angled backwards, to push coating fluid back towards the die inlet.

As indicated above, shut-off bar 110 moves in a direction essentially transverse or orthogonal to flow channel 105 and to the material flowing within channel 105. For embodiments of die 100 where flow channel 105 is essentially horizontal, shut-off bar 110 moves essentially vertically, and in preferred embodiments moves exactly vertically. Shut-off bar 110 can be actuated by any suitable magnetic, pneumatic, hydraulic, or mechanical means, although a magnetic actuator is preferred because of the fast acceleration and high accuracy. Some magnetic actuators are capable of the following features: travel distance 0.01 to 2 inches; acceleration 0.1 to 20 G's; peak force 0.3 to 300 lbs; continuous force 0.1 to 100 lbs; and resolution 0.0005 to 0.000004 inches. One example of a suitable magnetic actuator is a Voice Coil Positioning Stage, such as available from H2W Technologies, Inc. of Valencia, Calif. The Voice Coil Positioning Stage is particularly suited for short stroke lengths where intricate position, velocity and acceleration control is necessary.

To ensure consistent and even movement of shut-off bar 110 across its length, a plurality of actuators 140 is usually spaced along the length of shut-off bar 110, although in some embodiments, a single actuator 140 may be sufficient. FIG. 2 illustrates three actuators 140. Although actuators 140 may be manually controlled, for precision coating it is preferred that actuators 140 are computer controlled.

In some designs of die 100, a pressure relief valve and/or a material by-pass valve may be present in flow channel 105, close to the die inlet, usually upstream of the manifold. When shut-off bar 110 opens and closes in, for example, one second or less, the build-up of back pressure on upstream surface 114 of blade 112 is minimal. However, if shut-off bar 110 is closed for several seconds, the back pressure will be much higher, due to the accumulation of stopped coating material. For these processes, a pressure relief valve and/or by-pass valve in fluid communication with flow channel 105 can be included to release undesired pressure from flow channel 105. For example, if die 100 and the corresponding system are designed for operation at 30 psi, the relief valve would be set at 30 psi or slightly above 30 psi. If shut-off bar 110 is closed and the pressure starts to build up to undesired levels, the relief valve will open and by-pass fluid back to the die inlet, the coating material source, or to a reservoir. Maintaining a generally constant internal pressure results in a better coating.

To perform a patch coating operation with die 100, material to be coating is introduced to the inlet of die 100. A substrate, such as a film substrate, is fed in position proximate outlet 106. Those skilled in the art of coating will be able to adjust the tension of the substrate and the distance between outlet 106 and the substrate to provide a proper coating on the substrate. Knowing the desired run speed (i.e., substrate speed), the desired length of coating (e.g., coated region 6) and the desired length of un-coated area (e.g., un-coated region 7) between coated areas, the duration of 'coating on' and 'coating off' can be calculated, usually in seconds. To begin the coating, the coating material is passed through flow channel 105 (with shut-off bar 110 in the retracted or open position) to outlet 106 and coated onto the substrate. At the previously determined time, shut-off bar 110 is extended or closed via actuator(s) 140, blocking the flow of coating material through flow channel 105. After the determined 'off' time, shut-off bar 110 is raised or opened, allowing coating material to again flow through channel 105 and out via outlet 106.

As one particular example of using a coating die of this disclosure, die 100 can be used to form patch coatings on a substrate, each patch being 11.00 inches (about 28 cm) long (in the machine direction) and about 10 inches (25 cm) wide. Between adjacent patches is an uncoated region 0.787 inches (about 20 mm) long extending the width of the substrate. With the coating being done at 35 meters/minute, this requires coating material flowing for 2.09 seconds to form the patch and then the coating material flow being shut off for 0.03 second to form the uncoated region, afterwhich the coating material again flows.

Thus, various embodiments and features of the PATCH COATING DIE are disclosed. The implementations described above and other implementations are within the scope of the following claims. One skilled in the art will appreciate that the various features described may be used in conjunction with any of the other features described herein above or other features other than those disclosed. For example, although the discussion and figures have place the die oriented so that the flow channel extends essentially horizontal and the shut-off bar extends essentially vertical, other orientations of the die are within the scope of this invention. For example, the die may be designed to have the flow channel extend essentially vertical and the shut-off bar extends essentially horizontal. The disclosed embodiments are presented for purposes of illustration and not limitation, and the present invention is limited only by the claims that follow.

What is claimed is:

1. A coating die comprising:

a die body having a die inlet for receiving a coating material, a die outlet for delivering the coating material, and a flow channel in fluid communication with said die inlet and said die outlet, said flow channel having a first wall with a passage therethrough and a second solid wall opposite said passage, said flow channel having an upstream necked region, an enlarged region, and a downstream necked region, a shut-off bar positioned to extend into said flow channel proximate a transition from said enlarged region to said downstream necked region;

said shut-off bar positioned within said passage in said first wall and moveable from an open position to allow a flow of coating material from said die outlet to a closed position into said flow channel for blocking the flow of coating material from said die outlet, said shut-off bar having an end; and said shut-off bar end, in the closed position, extends into said flow channel without making contact with said second solid wall of said flow channel.

2. The coating die of claim 1 wherein said second solid wall includes a shoulder, said shut-off bar having an upstream surface and a downstream surface, and said shut-off bar, in the closed position, physically contacts said shoulder to dam the coating material and cause fluid pressure of the coating material to push against said upstream surface of said shut-off bar, such that said downstream surface of said shut-off bar is retained against said shoulder.

3. The coating die of claim 1 further comprising a plurality of magnetic actuators operably connected to said shut-off bar to move said shut-off-bar from the open position to the closed position, said magnetic actuators spaced apart along a length of said shut-off bar.

4. The coating die of claim 1, said shut-off bar having an upstream surface and a downstream surface, wherein said end is angled, slanted or sloped down from said upstream surface to said downstream surface to create a smooth transition in said first wall of said flow channel between said enlarged region of said flow channel and said downstream necked region, said second solid wall includes a shoulder, said shut-off bar, in the closed position, dams the coating material and causes fluid pressure of the coating material to push against said upstream surface of said shut-off bar, such that said downstream surface of said shut-off bar contacts said shoulder to block flow from said die outlet.

5. The coating die of claim 1, further comprising at least one of a pressure-relief valve and a by-pass valve in fluid communication with said flow-channel to release pressure in said flow-channel in excess of a predetermined pressure level.

6. The coating die of claim 1, wherein said end of said shut-off bar is located at said transition from said enlarged region of said flow-channel to said downstream necked region when said shut-off bar is in the open position.

7. A coating die comprising:

a die body having a die inlet for receiving a coating material, a die outlet for delivering the coating material, a flow channel in fluid communication with said die inlet and said die outlet, said flow channel having a first wall and an opposite second solid wall, and a shoulder adjacent to said second solid wall, said flow channel having an upstream necked region, an enlarged region, and a downstream necked region, said shoulder being defined by a transition from said enlarged region to said downstream necked region;

a shut-off bar moveable from an open position out of said flow channel to allow a flow of coating material from said die outlet to a closed position into said flow channel for blocking the flow of coating material from said die outlet, said shut-off bar having an upstream surface, a downstream surface, and an end;

said shut-off bar, in the closed position, extends across said flow channel, said end makes no contact with said second solid wall, and said downstream surface contacts said shoulder blocking flow from said die outlet.

8. The coating die of claim 7 further comprising a plurality of actuators operably connected to said shut-off bar to move said shut-off-bar from the open position to the closed position, said actuators spaced apart along a length of said shut-off bar.

9. The coating die of claim 7, wherein said end of said shut-off bar is slanted down from said upstream surface to said downstream surface to create a smooth transition in said first wall of said flow channel between said enlarged region of said flow channel and said downstream necked region.

10. The coating die of claim 7, wherein said shut-off bar, in the closed position, dams the coating material, and causes fluid pressure of the coating material to push against said upstream surface of said shut-off bar, such that said downstream surface of said shut-off bar is retained against said shoulder.

11. The coating die of claim 7, further comprising at least one of a pressure-relief valve and a by-pass valve in fluid communication with said flow-channel to release pressure in said flow-channel in excess of a predetermined pressure level.

12. The coating die of claim 7, wherein said end of said shut-off bar is located at said transition from said enlarged region of said flow-channel to said downstream necked region when said shut-off bar is in the open position.

* * * * *